US012111059B2

(12) United States Patent
Flesch et al.

(10) Patent No.: US 12,111,059 B2
(45) Date of Patent: Oct. 8, 2024

(54) FILTER DEVICE FOR A VAPOUR EXTRACTION DEVICE, AND VAPOUR EXTRACTION DEVICE WITH A FILTER DEVICE

(71) Applicant: BSH Hausgeräte GmbH, Munich (DE)

(72) Inventors: Sebastien Flesch, Gerstheim (FR); Guillaume Laurent, Bischoffsheim (FR)

(73) Assignee: BSH Hausgeräte GmbH, Munich (DE)

( * ) Notice: Subject to any disclaimer, the term of this patent is extended or adjusted under 35 U.S.C. 154(b) by 442 days.

(21) Appl. No.: 17/601,089

(22) PCT Filed: Apr. 9, 2020

(86) PCT No.: PCT/EP2020/060224
§ 371 (c)(1),
(2) Date: Oct. 4, 2021

(87) PCT Pub. No.: WO2020/212260
PCT Pub. Date: Oct. 22, 2020

(65) Prior Publication Data

US 2022/0154947 A1 May 19, 2022

(30) Foreign Application Priority Data

Apr. 17, 2019 (EP) ..... 19290025

(51) Int. Cl.
*F24C 15/20* (2006.01)

(52) U.S. Cl.
CPC ..... *F24C 15/2042* (2013.01); *F24C 15/2035* (2013.01)

(58) Field of Classification Search
CPC ..... F24C 15/2042; F24C 15/2035
USPC ..... 126/299 R
See application file for complete search history.

(56) References Cited

U.S. PATENT DOCUMENTS 4,105,422 A * 8/1978 Kiguchi ..... B01D 46/12 55/DIG. 36
6,162,286 A * 12/2000 Hasama ..... B01D 46/20 96/288
2005/0022482 A1 2/2005 Bockle
2013/0192182 A1* 8/2013 Bro mann ..... F24C 15/2035 55/385.4

(Continued)

FOREIGN PATENT DOCUMENTS

DE 10127679 A1 1/2003
DE 102005019830 A1 11/2006

(Continued)

OTHER PUBLICATIONS

International Search Report PCT/EP2020/060224 dated Jun. 15, 2020.

*Primary Examiner* — Avinash A Savani
(74) *Attorney, Agent, or Firm* — Michael E. Tschupp; Brandon G. Braun; Andre Pallapies

(57) ABSTRACT

A filter device for a vapor extraction device includes a grease filter, and a collecting container for collecting liquid. The collecting container includes an opening configured to receive at least part of an edge of the grease filter. The collecting container has an interior defined by a width which is greater than a thickness of the grease filter in a region in which the grease filter is located in the interior of the collecting container.

19 Claims, 3 Drawing Sheets

(56) References Cited

U.S. PATENT DOCUMENTS

2014/0053518 A1 2/2014 Haefele

FOREIGN PATENT DOCUMENTS

| | | | |
|---|---|---|---|
| EP | 3133349 | A1 | 2/2017 |
| EP | 3457033 | A1 | 3/2019 |

* cited by examiner

FILTER DEVICE FOR A VAPOUR EXTRACTION DEVICE, AND VAPOUR EXTRACTION DEVICE WITH A FILTER DEVICE

CROSS-REFERENCES TO RELATED APPLICATIONS

This application is the U.S. National Stage of International Application No. PCT/EP2020/060224, filed Apr. 9, 2020, which designated the United States and has been published as International Publication No. WO 2020/212260A1 and which claims the priority of European Patent Application, Serial No. 19290025.6, filed Apr. 17, 2019, pursuant to 35 U.S.C. 119(a)-(d).

The contents of International Application No. PCT/EP2020/060224 and German Patent Application, Serial No. PCT/EP2020/060224 are incorporated herein by reference in their entireties as if fully set forth herein.

BACKGROUND OF THE INVENTION

The present invention relates to a filter device for a vapor extraction device and a vapor extraction device with such a filter device.

Vapor and steam are generally produced during cooking operations. Vapor extraction devices are known, which can be used to suck away and clean the vapor and steam. Combination appliances for example are generally known for this purpose, in which a vapor extraction device is arranged below the cooktop. Filter cartridges can generally be used as grease filters in such vapor extraction devices, comprising for example layers of expanded metal, held in a fixed manner in a frame. The disadvantage of such types of filter is that the grease or other liquids deposited on the grease filter run down it and can drip off by way of the frame. This soils components of the vapor extraction device below the grease filter. As such components are generally located below the suction opening of the vapor extraction device in the interior of the vapor extraction device, they are difficult for the user to access.

BRIEF SUMMARY OF THE INVENTION

It is therefore the object of the present invention to create a filter device for a vapor extraction device, with which air is sucked away downwards by way of a suction opening, ensuring the reliable depositing of dirt from the air sucked in and simplifying the cleaning of the vapor extraction device.

According to a first aspect the object is achieved by a filter device for a vapor extraction device with a suction opening, by way of which air is sucked away downwards. The filter device is characterized in that the filter device has a grease filter and a collecting container for collecting liquid with an opening for receiving at least part of an edge of the grease filter and the width of the interior of the collecting container is greater than the thickness of the grease filter in the region in which the latter is located in the interior of the collecting container.

Unless otherwise stated, direction data, for example above and below as well as in front and behind, relates to the filter device and its component parts in an installed state, in which the filter device is installed in a vapor extraction device, in particular a vapor extraction device of a combination appliance comprising cooktop and vapor extraction device, in which air is sucked in downwards by way of a suction opening. The front face refers to the face facing the user. The rear face is the face generally facing a mounting wall. The rear face of the combination appliance is also preferably the face by way of which cleaned air is output from the combination appliance. The dimension in the direction between the front face and rear face of the combination appliance is referred to as the depth. The horizontal dimension perpendicular to it is referred to as the width. The vertical dimension is referred to as the height.

A vapor extraction device refers to a device by means of which air, in particular soiled air, for example in the form of vapor and steam, can be sucked downwards away from the space above a cooktop. In the vapor extraction device the air is cleaned by way of the filter device and emitted from the vapor extraction device as cleaned air or pure air. The vapor extraction device comprises a fan for this purpose.

The grease filter is preferably a flat filter, which can comprise for example layers of expanded metal or a metal mesh as the filter material. The grease filter can have a frame, in which the filter material is held in a fixed manner, in particular being clamped at the edges. The filter device has a collecting container. The collecting container refers to a container open at one face, which is the upper face of the collecting container in the installed state. The container preferably has an extended shape. The container serves to collect liquids, which are deposited on the grease filter, in particular on the filter material, and run down in or on the grease filter. The opening of the collecting container therefore serves to collect said liquid. The opening also serves to receive at least part of an edge of the grease filter. In particular the edge of the grease filter projects beyond the opening into the interior of the collecting container. The edge of the grease filter particularly preferably rests on the bottom of the collecting container. The width of the interior of the collecting container is greater than the thickness of the grease filter in the region in which the latter is located in the interior of the collecting container. The thickness of the grease filter refers to its dimension perpendicular to the surface of the grease filter. If the grease filter is made up of a number of filter elements, the thickness of the grease filter refers to the sum of the dimensions of the filter elements and where applicable any gaps between the filter elements. The width of the interior of the collecting container is the horizontal dimension of the interior in the direction perpendicular to the longitudinal direction of the collecting container. The edge of the grease filter, which is held in the collecting container, is preferably the lower edge of the grease filter.

Because the width of the interior in the region in which the grease filter is held in the collecting container is greater than the thickness of the grease filter, the quantity of liquid, in particular grease or other dirt, coming out of the grease filter is greater than the quantity of liquid that can be held in a frame of a filter element clamping filter material at the edge. Also a greater width of the collecting container means that the width of the opening of the collecting container can also be greater. This allows the collecting container not only to collect liquid from the lower edge of the grease filter but also, if the grease filter is arranged at an angle, to collect liquid dripping down some distance from the lower edge of the grease filter.

According to one embodiment at least one grease filter is arranged at an angle in the filter device. This enlarges the filter surface of the grease filter with little height and ensures a specific flow of liquids along the grease filter compared with a horizontally aligned grease filter.

According to one preferred embodiment the grease filter is V-shaped and the collecting container encloses the grease filter at the tip of the V-shape. The open face of the V-shape faces upwards. The grease filter here can be configured in one part or multiple parts. In particular a filter element can be bent or folded to form the V-shape. Because the grease filter is V-shaped, the filter surface can be maximized with little height. It also improves the flow angle, at which the air sucked in by way of a suction opening of a vapor extraction device above the filter device, flows to the grease filter. In particular it prevents a parallel flow, as would result with vertically aligned grease filters. Because the collecting container is arranged at the tip of the V-shape, it can collect liquid from both arms of the grease filter.

According to one embodiment the grease filter is designed to fold. In the case of a single-part grease filter this can be achieved by the selection of the filter material. Alternatively, in the case of a single-part grease filter, the filter material can be weakened at the tip of the V-shape, allowing the filter element to be folded and in particular to be collapsed. Because the grease filter can be folded, it can be collapsed for example so that it can be inserted into and removed from a suction opening of a vapor extraction device, only being unfolded when in position below the suction opening.

The grease filter can also comprise two filter elements. In the case of a two-part grease filter the individual filter elements can be fastened to one another in a pivotable manner. This can be done directly or indirectly. In particular the filter elements can be connected to one another by way of a hinge or by way of the collecting container, each of the filter elements being fastened pivotably thereto. According to one embodiment the grease filter therefore comprises at least two filter elements, which are connected pivotably to the collecting container.

According to one embodiment the grease filter is connected to the collecting container in a non-releasable manner. This embodiment has the advantage that the grease filter can be taken out of a vapor extraction device and cleaned together with the collecting container. It is also within the scope of the invention for the grease filter to be fastened to the collecting container in a releasable manner. With such an embodiment fastening is preferably such that it can only be released by a movement which is different from the pulling apart of the collecting container and the grease filter. With such a fastening the grease filter can therefore also be removed from a vapor extraction device together with the collecting container and be detached from the collecting container for example by pivoting the grease filter through a large angle after removal.

According to one embodiment the filter device has at least one deflector element, which partially covers the opening of the collecting container. An air conducting element is referred to as a deflector element. The deflector element is therefore preferably made of a material that does not allow the passage of air. Because the deflector element partially covers the opening of the collecting container, a calmed zone can be created in the collecting container below the deflector element. This zone prevents liquid deposited in the grease filter being carried along by the air flow generated by the fan in the vapor extraction device. In particular in the lower region of the grease filter where a larger quantity of liquid collects, the air flow from the vapor extraction device is prevented from carrying said liquid out.

At least one deflector element can be a web, which points from an upper edge of the collecting container into the opening of the collecting container. In particular the collecting container can be an open rail and the web can be provided at the free end of at least one of the arms of the rail. This deflector element in the form of a web creates a calmed zone in the collecting container. Such a web and preferably two opposing webs at the opening also prevent liquid that has collected in the collecting container spilling when the filter device is removed from a vapor extraction device.

According to a further embodiment at least one deflector element is displaced away from the collecting container at the open end of the collecting container and moved inwards on at least one side edge of the opening of the collecting container. This creates gaps for the grease filter between the deflector element and the edge of the opening of the collecting container. Also the displacement away from the container, in particular vertically, enlarges the calmed region and therefore ensures the collection of liquids from a larger lower region of the grease filter in the collecting container.

According to one embodiment the deflector element is an L-profile and is arranged such that the free ends of the profile face the opening of the collecting container. This causes an air flow flowing from above to split at the deflector element.

According to a further aspect the invention relates to a vapor extraction device for sucking air away from a cooktop, the vapor extraction device having a suction opening by way of which air is sucked away downwards. The vapor extraction device is characterized in that the vapor extraction device has at least one inventive filter device.

Advantages and features described above and below in relation to the filter device also apply—where relevant—to the vapor extraction device and vice versa and are only described once in some instances.

The at least one filter device is preferably arranged below the suction opening.

BRIEF DESCRIPTION OF THE DRAWINGS

The present invention is described in more detail again in the following with reference to the accompanying figures, in which.

DETAILED DESCRIPTION OF EXEMPLARY EMBODIMENTS OF THE PRESENT INVENTION

Figure 1:
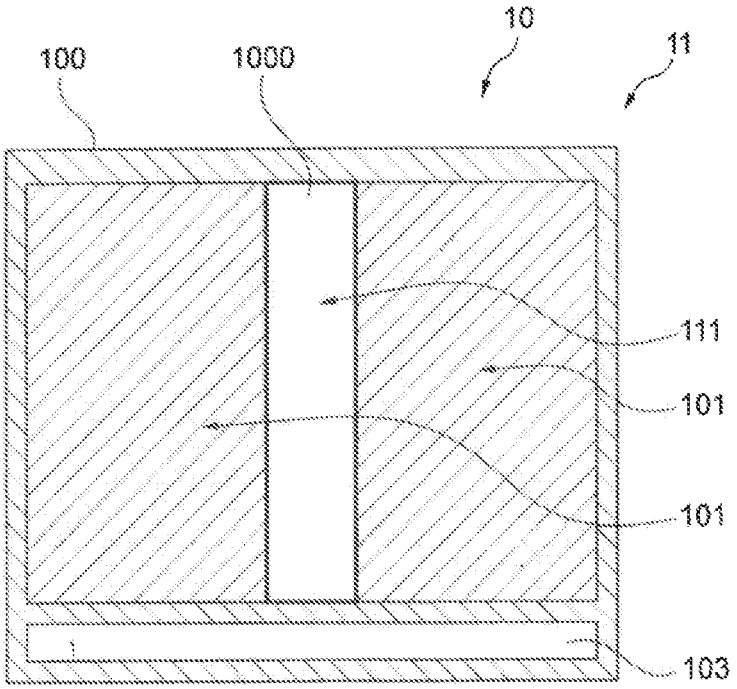
FIG. 1 shows a schematic plan view of a cooktop with a vapor extraction device.

FIG. 1 shows a schematic plan view of a cooktop 10 with a vapor extraction device 11, of which only the suction opening 111 is visible in FIG. 1.

The cooktop 10 comprises a cover plate 100 and cooking modules 101 arranged below the cover plate 100. Two cooking modules 101 are provided in the illustrated embodiment. A recess 1000 is incorporated in the cover plate 100, forming a suction opening 111. In the embodiment shown the recess 1000 is incorporated in the center of the width of the cover plate 100 and extends in the depthwise direction. In the illustrated embodiment the recess 1000 has an extended rectangular shape. The length of the recess 1000, in other words its dimension in the depthwise direction, corresponds to the length of the cooking modules 101. The cooking modules 101 are arranged to the left and right of the recess 1000. An operating unit 103 is arranged in the front region of the cooktop 10. In the embodiment shown the operating unit 103 is arranged in front of the recess 1000 in the cover plate 100 and can comprise for example touch operating elements, buttons or knobs. A display (not shown) can also be contained in the operating unit 103. Depending on their configuration the individual elements of the operating unit 103 can be arranged on, within and/or below the cover plate 100. At least the operating electronics (not shown) of the operating unit 103 are arranged below the cover plate 100. A fan (not shown) of the vapor extraction device 11 is arranged below the cooktop, by way of which air is sucked in through the recess 1000, which provides the suction opening 111.

Figure 2:
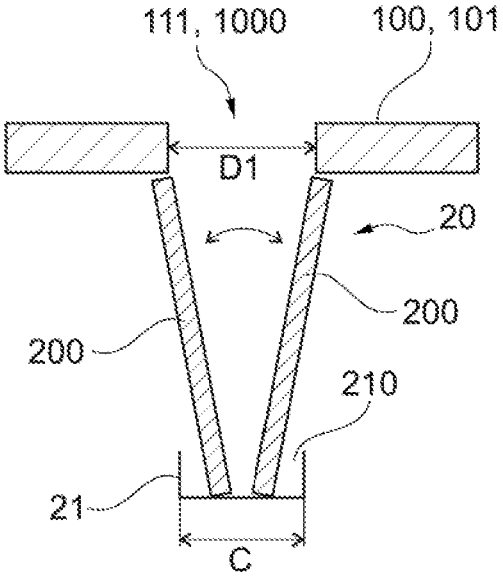
FIG. 2 shows a schematic sectional view of a first embodiment of an inventive filter device.

FIG. 2 shows a schematic sectional view of a first embodiment of the inventive filter device 2, which can also be referred to as a filter unit. In this diagram the suction opening 111 of the vapor extraction device is formed by the recess 1000 in the cover plate 100 of the cooktop 10 or between the cooking modules 101. The filter device 2 comprises a grease filter 20 and a collecting container 21. In the present embodiment the grease filter 20 comprises two filter elements 200, which are arranged at an angle to one another and form a V-shape. The lower faces of the filter elements 200 are held in the collecting container 21. In the embodiment shown the collecting container 21 is a rail that is open at the top. The suction opening 111 has a width D1 and the collecting container 21 has a width C. The width C is smaller than or equal to the width D1. The filter elements 200 can be moved, in particular be pivoted, relative to the collecting container 21. This allows the grease filter 20 to be collapsed by collapsing the filter elements 200, as shown by the double arrow in FIG. 2. The grease filter 20 can be removed upwards through the suction opening 111 in the collapsed state.

Figure 3:
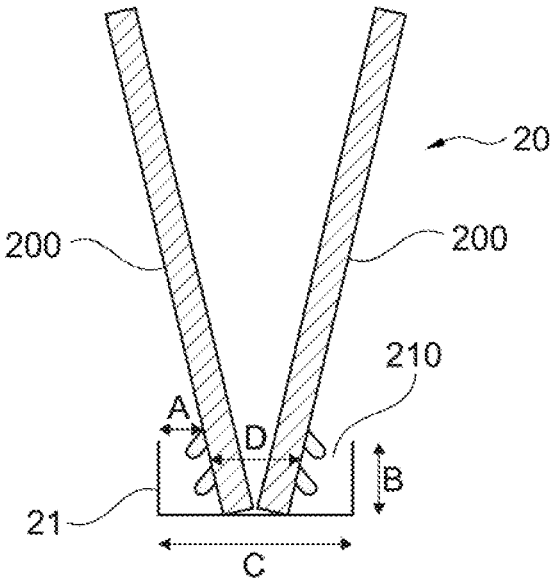
FIG. 3 shows the sectional view from FIG. 2 with dimensioning.

FIG. 3 shows the embodiment of the filter device 2 from FIG. 2 with dimensioning. In particular the collecting container 21 has a width C and a height B. The distance to the outside of the filter elements 20 in the region of the opening 210 of the collecting container 21 is shown as A. The difference between the width C and twice the distance A is the thickness of the grease filter in the interior of the collecting container 21 in the region of the opening 210. The width of the interior is therefore twice the distance A greater than the thickness of the grease filter 20. The thickness D of the grease filter 20 is determined here by the material thickness of the two filter elements 200 and the distance between these in the opening 210 of the collecting container 21. As shown in FIG. 3, liquid can drip off the grease filter 20 and be collected in the collecting container 21 in the region of the grease filter 20 and in particular of the filter elements 200 held in the interior of the collecting container 21.

Figure 4:
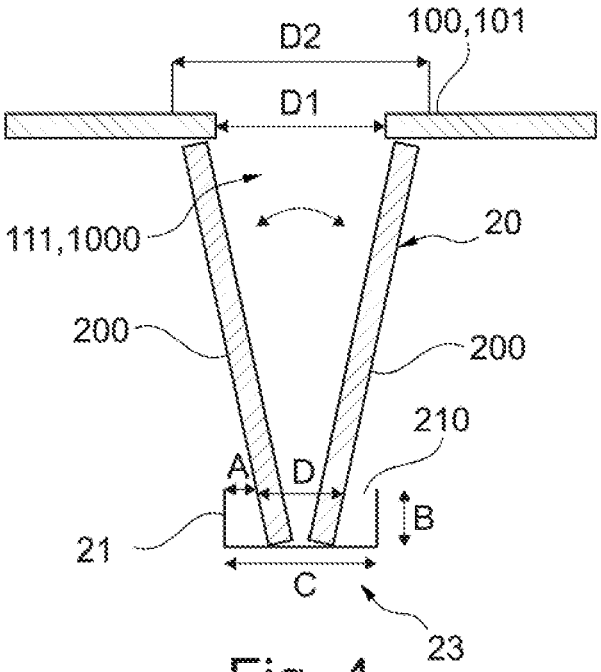
FIG. 4 shows a schematic sectional view of a second embodiment of the inventive filter device.

FIG. 4 shows a second embodiment of the filter device 2. The embodiment differs from the embodiment shown in FIGS. 2 and 3 only in that the filter elements 200 of the grease filter 20 are fastened to the bottom of the collecting container 21 by way of hinges 23. This allows the thickness D2 of the grease filter 20 at its upper end to be reduced to at least the width D1 of the suction opening 111 during removal. The further configuration of the second embodiment corresponds to that of the first embodiment and is therefore not described again.

Figure 5:
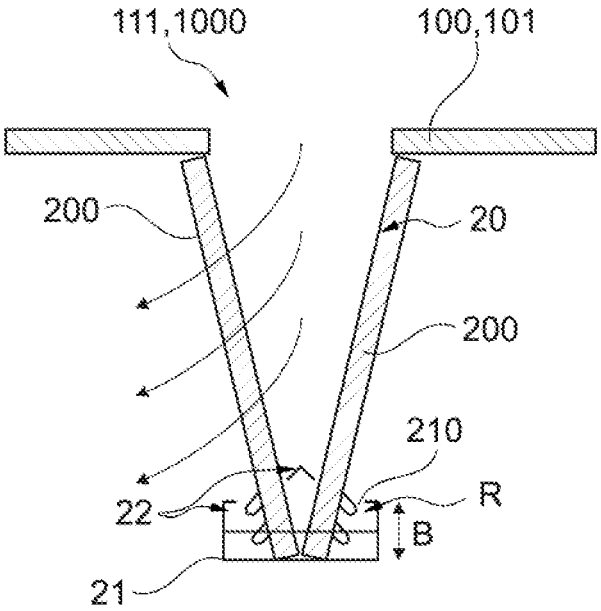
FIG. 5 shows a schematic sectional view of a third embodiment of the inventive filter device.

FIG. 5 shows a third embodiment of the filter device 2. The embodiment differs from the embodiment shown in FIGS. 2 and 3 only in that deflector elements 22 are provided on the filter device 2. In particular deflector elements 22 in the form of two webs are provided on the upper edge of the rail-type collecting container 21, extending inwards into the opening 210 of the collecting container 21 from the free ends of the arms of the rail. The length of the webs is only long enough for there still to be a gap between the outsides of the filter elements 200 and the ends of the webs. This gap ensures that liquids can enter from the outside of the respective filter element 200. In the third embodiment a further deflector element 22 is also arranged between the filter elements 200, being referred to as the upper deflector element in the following. The upper deflector element 22 is an L-profile, arranged such that the free ends of the profile face the opening 210 of the collecting container 21, in other words point downwards. The upper deflector element 22 can be fastened to the longitudinal ends of the collecting container 21, for example by way of fastening elements projecting upwards. In particular a front wall (not shown) of the collecting container, with a greater height than the side walls of the collecting container 21, can serve as a fastening element. The length of the arms of the L-profile is dimensioned such that the free ends are at a distance from the facing faces of the filter elements 200. This allows liquid to run down the facing faces of the filter elements into the collecting container 21.

The bottom of the collecting container 21 can be configured differently from the illustrated embodiments so that liquid flows from the sides to the center. The bottom can be angled for example towards the center for this purpose.

The present invention creates a filter device, in which liquids, in particular grease, can be stored particularly reliably. With the inventive filter device in the case of a V-shaped grease filter the grease can be stored not only in the center, in other words at the apex of the V-shaped grease filter, but also outside the V-shape or in the case of a U-shaped grease filter outside the U-shape. The distance A between the outside of the grease filter and the edge of the opening of the collecting container is greater than a normal grease drip, being for example in the region between 5 mm and 5 cm. The quantity of grease that can be stored in the collecting container can be expressed by the formula C×B× length of the filter, where C is the width, C is the height of the collecting container. The collecting container can also be designed such that grease can pass from the side to the center. The bottom of the collecting container can be angled towards the center for this purpose. According to one embodiment the V-shaped filter can be collapsed so that it can be removed upwards from a housing and in particular by way of a suction opening of a vapor extraction device. The present invention improves grease depositing rates and also allows smaller grease particles to be trapped reliably.

The invention claimed is:

1. A filter device for a vapor extraction device, said filter device comprising:

a grease filter;

a collecting container for collecting liquid, said collecting container including an opening configured to receive at least part of an edge of the grease filter, said collecting container having an interior defined by a width which is greater than a thickness of the grease filter in a region in which the grease filter is located in the interior of the collecting container, and a deflector element configured to partially cover the opening of the collecting container.

2. The filter device of claim 1, wherein the grease filter has a V-shaped configuration which defines a tip, said collecting container enclosing the grease filter at the tip of the V-shape.

3. The filter device of claim 1, wherein the grease filter is designed to fold.

4. The filter device of claim 1, wherein the grease filter comprises at least two filter elements, which are connected pivotably to the collecting container.

5. The filter device of claim 1, wherein the grease filter is connected to the collecting container in a non-releasable manner.

6. The filter device of claim 1, wherein the deflector element is a web, which points from an upper edge of the collecting container into the opening of the collecting container.

7. The filter device of claim 6, wherein the collecting container is an open rail having an arm, said web being provided at a free end of the arm of the rail.

8. The filter device of claim 6, wherein the deflector element is displaced away from the collecting container at an open end of the collecting container and moved inwards on a side edge of the opening of the collecting container.

9. The filter device of claim 1, wherein the deflector element is an L-profile defining free ends, said deflector element being arranged such that the free ends of the profile face the opening of the collecting container.

10. A vapor extraction device, comprising:

a suction opening to allow sucking of air downwards away from a space above a cooktop;

a filter device for cleaning the air, said filter device comprising a grease filter and a collecting container for collecting liquid, said collecting container including an opening configured to receive at least part of an edge of the grease filter, said collecting container having an interior defined by a width which is greater than a thickness of the grease filter in a region in which the grease filter is located in the interior of the collecting container, and a deflector element configured to partially cover the opening of the collecting container.

11. The vapor extraction device of claim 10, wherein the filter device is arranged below the suction opening.

12. The vapor extraction device of claim 10, wherein the grease filter has a V-shaped configuration which defines a tip, said collecting container enclosing the grease filter at the tip of the V-shape.

13. The vapor extraction device of claim 10, wherein the grease filter is designed to fold.

14. The vapor extraction device of claim 10, wherein the grease filter comprises at least two filter elements, which are connected pivotably to the collecting container.

15. The vapor extraction device of claim 10, wherein the grease filter is connected to the collecting container in a non-releasable manner.

16. The vapor extraction device of claim 10, wherein the deflector element is a web, which points from an upper edge of the collecting container into the opening of the collecting container.

17. The vapor extraction device of claim 16, wherein the collecting container is an open rail having an arm, said web being provided at a free end of the arm of the rail.

18. The vapor extraction device of claim 16, wherein the deflector element is displaced away from the collecting container at an open end of the collecting container and moved inwards on a side edge of the opening of the collecting container.

19. The vapor extraction device of claim 10, wherein the deflector element is an L-profile defining free ends, said deflector element being arranged such that the free ends of the profile face the opening of the collecting container.

* * * * *